US009346150B1

(12) United States Patent
Faverio, IV et al.

(10) Patent No.: US 9,346,150 B1
(45) Date of Patent: May 24, 2016

(54) DUCT CLOSURE TOOL

(71) Applicant: PTM MANUFACTURING, LLC, Newark, DE (US)

(72) Inventors: Louis Peter Faverio, IV, Bear, DE (US); Jerry Lee Arms, Newark, DE (US)

(73) Assignee: PTM Manufacturing, LLC, Newark, DE (US)

( * ) Notice: Subject to any disclaimer, the term of this patent is extended or adjusted under 35 U.S.C. 154(b) by 313 days.

(21) Appl. No.: 14/040,828

(22) Filed: Sep. 30, 2013

(51) Int. Cl.
*B25B 5/04* (2006.01)

(52) U.S. Cl.
CPC ..... *B25B 5/04* (2013.01)

(58) Field of Classification Search
CPC .. B25B 5/04; B21D 39/025; Y10T 29/53222; Y10T 29/53226
See application file for complete search history.

(56) References Cited

U.S. PATENT DOCUMENTS

| | | | | |
|---|---|---|---|---|
| 2,572,738 | A | 10/1951 | Lovinggood | |
| 3,330,147 | A | 7/1967 | Wieters | |
| 3,570,299 | A | 3/1971 | Wieters | |
| 4,553,422 | A | 11/1985 | Bilkie | |
| 4,637,084 | A | 1/1987 | Wood | |
| 5,138,864 | A | 8/1992 | Tarpill | |
| 5,280,716 | A | 1/1994 | Ryan et al. | |
| 5,904,078 | A * | 5/1999 | Gustafson | B25B 7/10 30/261 |
| D520,828 | S | 5/2006 | Steiner | |
| 7,823,433 | B2 | 11/2010 | Zhang | |
| 8,312,755 | B1 | 11/2012 | Steiner et al. | |

* cited by examiner

*Primary Examiner* — Moshe Wilensky
(74) *Attorney, Agent, or Firm* — Panitch Schwarze Belisario & Nadel LLP

(57) ABSTRACT

A hand-held duct closure tool 10 has teeth 24, 30 extending outwardly from the distal ends of two pivotably engaged arms 18, 20. The teeth penetrate into insulation material of abutting sections of insulated ducts or ductwork. When the user releases the tool, the teeth from each distal end remain engaged with the insulation material and are urged toward one another to hold the insulated duct sections in abutting relation.

10 Claims, 3 Drawing Sheets

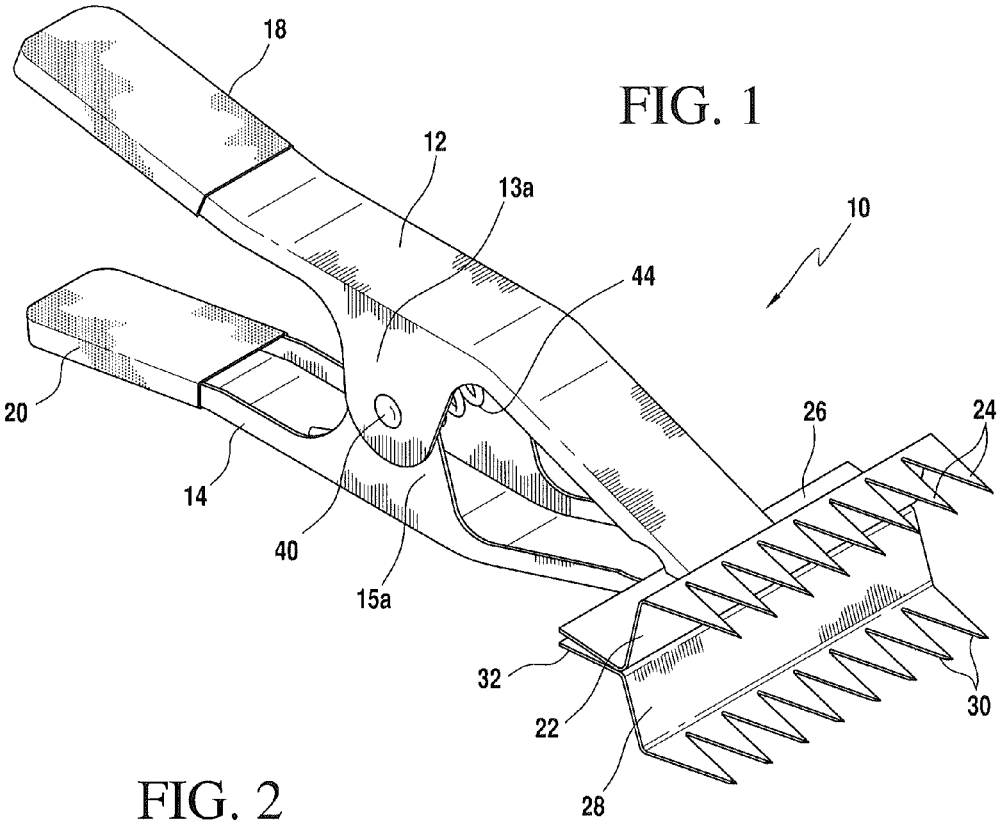
FIG. 1
FIG. 2
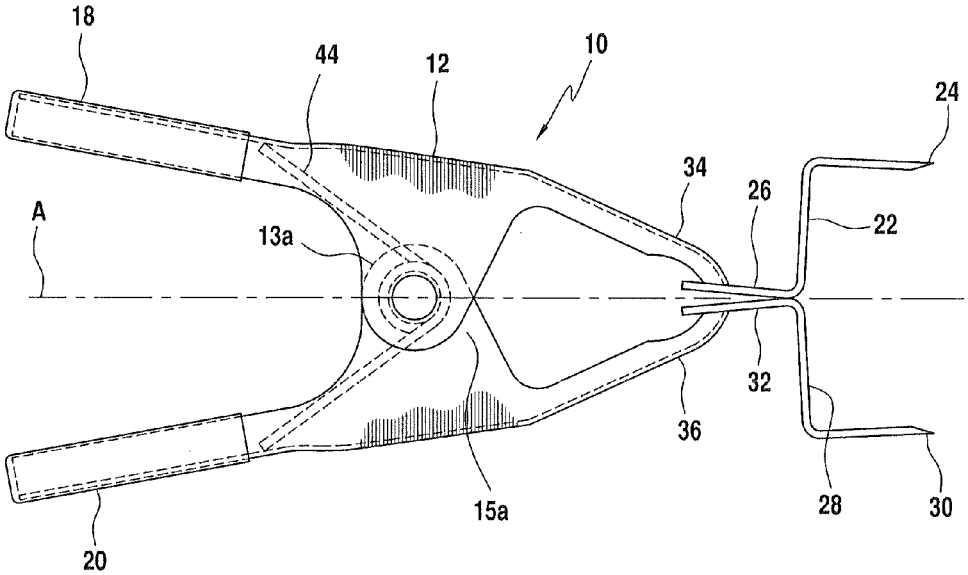

DUCT CLOSURE TOOL

BACKGROUND OF THE INVENTION

1. Field of the Invention

The invention relates generally to tools for installing and assembling heating, ventilation and air conditioning system ducts, and more particularly to a tool for holding adjacent insulated duct panels or ducts in abutting relation so that such insulated duct panels or ducts may be joined together with duct tape or other fasteners.

2. Background

Heating, ventilation and air conditioning systems use ventilation air ducts installed throughout a building to supply conditioned air to a room through outlet vents, and ducts to remove air through return grilles. Galvanized mild steel is the standard and most common material used in fabricating ductwork. For insulation purposes, metal ducts may be lined with faced fiber glass blanket (duct liner) or wrapped externally with fiber glass blankets (duct wrap).

Traditionally, air ductwork was made of sheet metal which was installed first and then lagged with insulation as a secondary operation. Aluminium tape was applied to all seams where the external surface of the aluminium foil had been cut. Internal joints then could be sealed with sealant. The traditional ductwork installation was highly labor intensive.

More recently, duct panels already combined with exterior insulation panels or coverings have been available. Joining abutting edges of the insulated duct panels presents problems because the edges of the insulation and the underlying aluminum facer duct must be held together firmly so that appropriate aluminum tape or duct tape or other appropriate fastening means can be applied. Heretofore, one member of an installation team held the duct panels adjacent to one another while another member of the installation team applied the tape or fastening means. A tool that maintains adjacent insulated duct panels in abutting relation was not available.

SUMMARY OF THE INVENTION

The present invention in a first aspect is directed to a duct closure tool that has two handle arms engaged at a pivot for pivotable movement with respect to one another. Each handle arm has a gripping end and a distal end. A spring acts on the two arms to urge their distal ends toward one another. By squeezing the gripping ends of the handle arms toward one another, the spring action on the handle arms is overcome and the distal ends are urged apart. Preferably, the spring is a helical torsion spring.

A first row of teeth extends outwardly and away from the distal end of the first handle arm in a direction substantially parallel to the central axis of the duct closure tool. A second row of teeth extends outwardly and away from the distal end of the second handle arm in a direction substantially parallel to the central axis of the duct closure tool. The first row of teeth preferably extends from a first fixture joined to or integrally formed with the distal end of the first handle arm. The second row of teeth preferably extends from a second fixture joined to or integrally formed with the distal end of the second handle arm. The teeth preferably have pointed ends adapted for piercing insulation materials, such as the insulation on insulated duct panels. Each of the first fixture and second fixture may have substantially flat front faces from which the first row of teeth and the second row of teeth, respectively, project or extend outwardly.

The present invention in a second aspect is directed to a method for holding edges of insulated ducts in abutting relation using a duct closure tool. The method comprises aligning an edge of a first insulated duct in abutting relation to an edge of a second insulated duct. Then, the first and second handles of a duct closure tool according to the invention are compressed to separate the first row of teeth from the second row of teeth. The first insulated duct is pierced with the first row of teeth. The second insulated duct is pierced with the second row of teeth. When the handle is released, the action of the spring of the duct closure tool urges the distal ends of the handles toward one another. As a result, the first insulated duct and the second insulated duct are held in abutting relation. The members of the installation team need not hold the first insulated duct and second insulated duct together because the duct closure tool urges the first insulated duct and second insulated duct together in a hands free manner.

Advantages of the tool and method will appear from the drawings and following description.

BRIEF DESCRIPTION OF THE DRAWINGS

The invention described above will be explained in greater detail below on the basis of embodiments and with reference to the accompanying drawings in which:

FIG. 1 is a left front perspective view of a duct closure tool according to the invention;

FIG. 2 is a left side elevational view of the duct closure tool of FIG. 1;

DETAILED DESCRIPTION OF THE PREFERRED EMBODIMENTS

Figure 3:
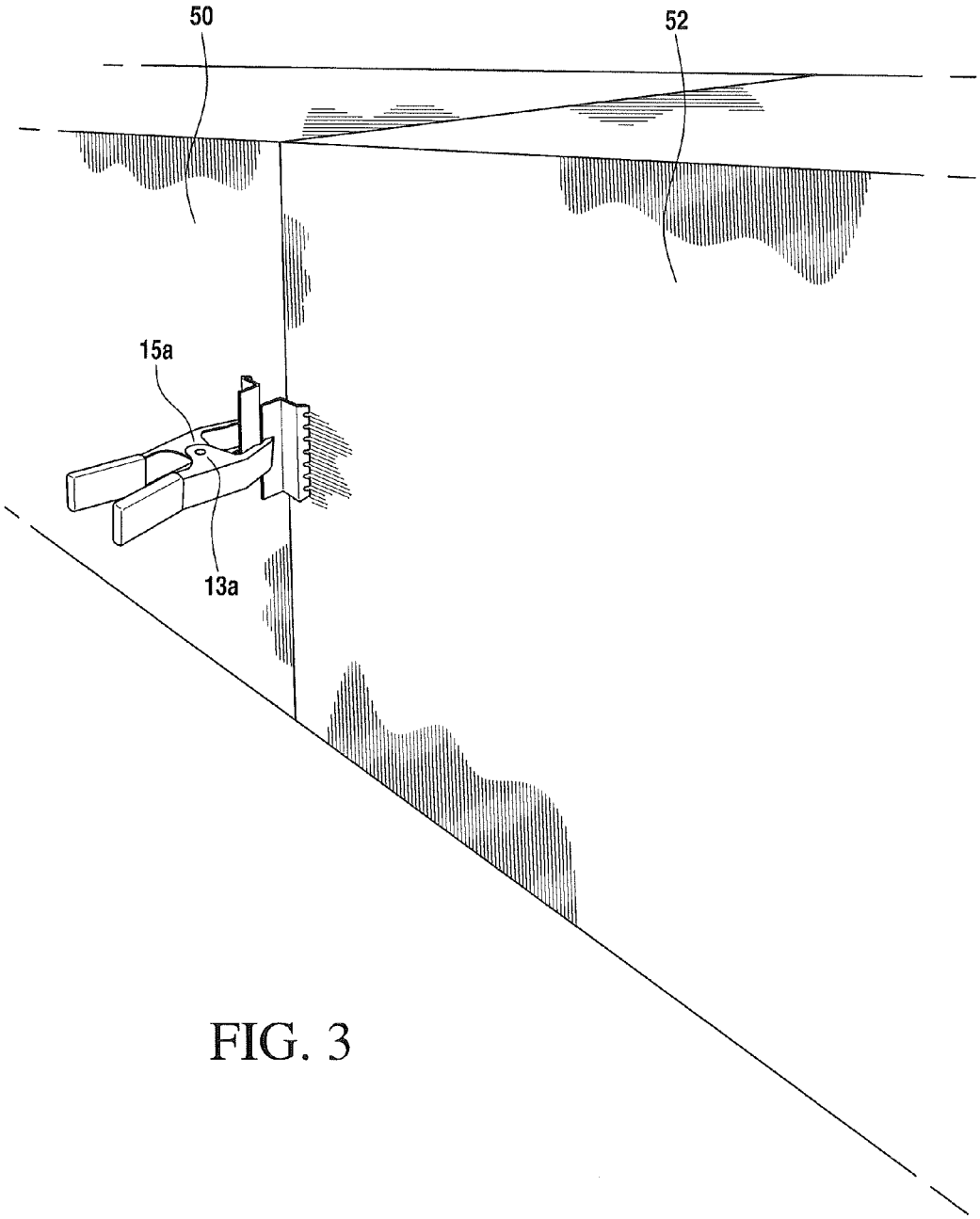
FIG. 3 is a perspective view of the duct closure tool of FIG. 1 engaged to abutting edges of insulated ducts.

Turning in detail to the drawings, FIGS. 1 and 2 illustrate a duct closure tool 10 in a closed position. The duct closure tool 10 generally resembles a pair of closure pliers, or a spring clamp, and may be formed of a suitable hand tool material, such as a metal, and more preferably carbon tool steel, nickel-plated steel, or carbon tool steel alloyed with chrome, vanadium and moly. A representative spring clamp is a Pittsburgh brand steel spring clamp SKU 39529.

The duct closure tool 10 has a first handle arm 12, and a second handle arm 14 pivotally connected to one another at pivot 40. The first handle arm 12 has a first gripping end 18 and a distal end 34. The second handle arm 14 has a second gripping end 20 and a distal end 36. The first gripping end 18 and second gripping end 20 may be coated or covered with a grip facilitating material, such as rubber or thermoplastic, including vinyl, or a grip tape.

The first handle arm 12 has shoulders or side extensions 13*a*, 13*b* extending downwardly from the outer face of the first handle arm 12. The second handle arm 14 has shoulders or side extensions 15*a*, 15*b* extending downwardly from the outer face of the second handle arm 14. The shoulders or side extensions 13*a*, 13*b* engage with the shoulders or side extensions 15*a*, 15*b*. A pivot or rivet 40 is inserted through openings in the shoulders or side extensions 13*a*, 13*b*, 15*a*, 15*b* to join the first handle arm 12 to the second handle arm 14. The pivot or rivet 40 permits pivotal movement between the first handle arm 12 and second handle arm 14.

Figure 4:
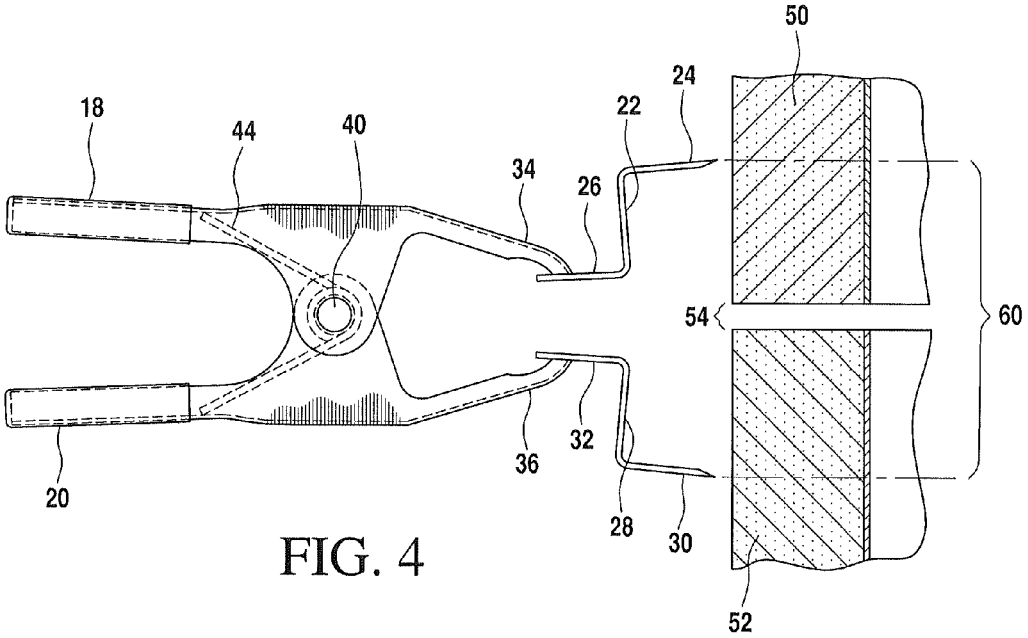
FIG. 4 is a left side elevational view of the duct closure tool of FIG. 1 in open position prior to engaging two insulated ducts.

The first handle arm 12 has a distal end 34. The second handle arm 14 has a distal end 36. When in the closed position as shown in FIGS. 1 and 2, the distal ends 34, 36 are proximate to one another. When in the open position as shown in FIG. 4, the distal ends 34, 36 are spaced apart a distance, such as, for example, about 5 cm. A central axis A of the closure tool 10 extends from the pivot 40 to the distal ends 34, 36 or the midpoint between the distal ends 34, 36 as shown in FIG. 2.

A first fixture is formed with or joined to the distal end 34 of the first handle arm 12. The first fixture has a crimp face 22 and a head face 26. A bend is formed between the crimp face 22 and head face 26. The second fixture has a crimp face 28 and a head face 32. A bend is formed between the crimp face 28 and the head face 32. The crimp faces 22, 28 in one embodiment have a width of about 7 to about 8 cm, and a length of about 1.5 to about 3 cm. The first and second fixtures may be formed of the same material or different material than the first and second handle arms. For example, the first and second fixtures may be formed of a metal, such as carbon tool steel, nickel-plated steel, or carbon tool steel alloyed with chrome, vanadium and moly. The first and second fixtures may be joined to the distal ends of the handle arms by welding or other suitable metal joining technique.

A first row of teeth 24 extends from the crimp face 22 of the first fixture. The first row of teeth 24 extends outwardly from the crimp face 22 in a direction parallel or substantially parallel to the axis A. The teeth of the first row of teeth 24 have pointed tooth ends. The teeth of the first row in one embodiment have a length of about 1.5 to 3.0 cm, preferably about 2 cm. Although shown as a row of multiple teeth 24, it alternatively would be suitable for a single tooth or sharp edge to extend from the crimp face 22 of the first fixture. In a preferred embodiment as shown in FIGS. 1 and 2, the first row of teeth 24 is cut from the same material from which the first fixture is formed. Alternatively, the tooth or row of teeth 24 may be joined to the crimp face 22.

A second row of teeth 30 extends from the crimp face 28 of the second fixture. The second row of teeth 30 extends outwardly from the crimp face 28 in a direction parallel or substantially parallel to the axis A. The teeth of the second row of teeth 30 have pointed tooth ends. The teeth of the second row in one embodiment have a length of about 1.5 to 3.0 cm, preferably about 2 cm. Although shown as a row of multiple teeth 30, it alternatively would be suitable for a single tooth or sharp edge to extend from the crimp face 28 of the second fixture. In a preferred embodiment as shown in FIGS. 1 and 2, the second row of teeth 30 is cut from the same material from which the second fixture is formed. Alternatively, the tooth or row of teeth 30 may be joined to the crimp face 28.

A spring 44 is installed around the pivot or rivet 40. As shown in FIGS. 1 and 2, the spring 44 is a helical torsion spring of heavy duty tempered steel. Each end of the spring 44 contacts an inner face of one of the first and second handle arms 12, 14. The spring 44 urges apart the gripping ends 18, 20 of the first handle arm 12 and second handle arm 14. By urging apart the gripping ends 18, 20 of the first handle arm 12 and second handle arm 14, the distal ends 34, 36 of the first handle arm 12 and second handle arm 14 are urged toward one another.

Figure 5:
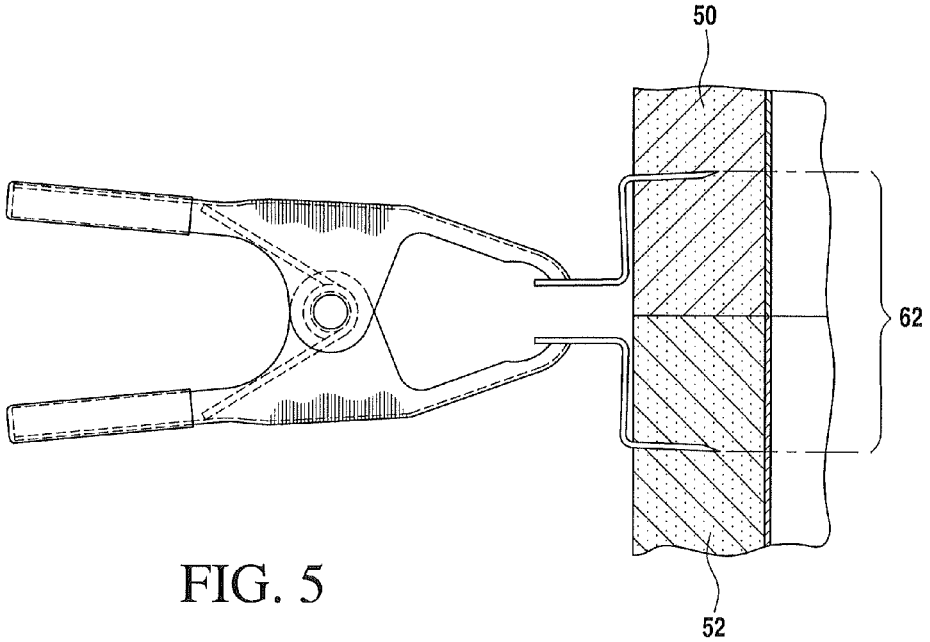
FIG. 5 is a left side elevational view of the duct closure tool of FIG. 1 in closure position engaged to two insulated ducts.

Referring next to FIGS. 3-5, a method of using the duct closure tool 10 to hold edges of insulated ducts in abutting relation is shown. Referring first to FIG. 4, a first insulated duct section 50 is spaced apart from a second insulated duct second 52 by a spaced distance 54. The first handle arm 12 and second handle arm 14 are gripped at their gripping ends 18, 20 and squeezed to overcome the force of spring 44 and thereby urge the gripping ends 18, 20 toward one another. By pivoting movement, the distal ends 34, 34 of the first handle arm 12 and second handle arm 14 are urged apart from one another. At the same time, the first row of teeth 24 and the second row of teeth 30 are spaced further apart from one another by a spaced distance 60. The duct closure tool 10 is shown in FIG. 4 before the first row of teeth 24 or the second row of teeth 30 penetrate into the insulation forming the first insulated duct section 50 or the insulation forming the second insulated duct section 52. While the first row of teeth 24 and the second row of teeth 30 are in such spaced apart position, the user pierces or penetrates the teeth 24 into the insulation forming the first insulated duct section 50 and pierces or penetrates the teeth 30 into the insulation forming the second insulated duct section 52. The user then releases the gripping ends 18, 20 of the duct closure tool 10.

Referring next to FIG. 5, after the gripping ends 18, 20 of the duct closure tool 10 are released, the spring 44 urges the gripping ends 18, 20 away from one another. The pivoting movement of the first handle arm 12 relative to the second handle arm 14 causes the distal ends 34, 36 of the first handle arm 12 and the second handle arm 14 to move toward one another to close the space 54 between them. Comparing FIG. 5 to FIG. 4, the space 54 between the first insulated duct section 50 and second insulated duct section 52 of FIG. 4 is closed in FIG. 5. There is no spaced distance between the first insulated duct section 50 and second insulated duct section 52 in FIG. 5. Moreover, the space distance 62 between the first row of teeth 24 and the second row of teeth 30 is shortened, such that distance 60 in FIG. 4 is longer than distance 62 in FIG. 5.

As can be seen in FIGS. 3 and 5, the first and second rows of teeth 24, 30 penetrate substantially into the insulation material forming the first insulated duct section 50 and second insulated duct section 52, respectively. If desired, the teeth 24, 30 may penetrate to a depth comparable to their full length or substantially their full length, and the crimp faces 22, 28 of the first and second fixtures may contact the exterior surfaces of the first insulated duct section 50 and second insulated duct section 52, respectively.

Once the duct closure tool 10 is installed to hold a first insulated duct section 50 in abutting relation to a second insulated duct section 52, such tool remains in place to hold the first and second insulated duct sections in position. The user need not continue to hold the first and second gripping ends 18, 20. With the first and second insulated duct sections 50, 52 now held temporarily in abutting relation by the duct closure tool 10, the user may apply aluminum tape or other appropriate fastener or other sealing means to join the first insulated duct section to the second insulated duct section. Once the first and second insulated duct sections 50, 52 are suitably joined together, the user may remove the duct closure tool 10 by withdrawing the first and second rows of teeth 24, 30 from the insulation material.

While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A duct closure tool, comprising:

a first handle arm having a proximal gripping end and a distal end;

a second handle arm having a proximal gripping end and a distal end, wherein the second handle arm is pivotally engaged to the first handle arm at a pivot;

a spring acting on the first handle arm and second handle arm to urge the distal end of the first handle arm and the distal end of the second handle arm toward one another;

said first handle arm and second handle arm defining a central axis that extends from the pivot to the distal ends of the first handle arm and second handle arm;

a first fixture formed with or joined to the distal end of the first handle arm, said first fixture having a head face and a crimp face, with the head face defining a plane that is substantially parallel to the central axis and the crimp face defining a plane that is substantially perpendicular to the axis;

a second fixture formed with or joined to the distal end of the second handle arm, said second fixture having a head face and a crimp face, with the head face defining a plane that is substantially parallel to the axis and the crimp face defining a plane that is substantially perpendicular to the central axis;

a first row of teeth, each tooth in said row extending outwardly and away from the crimp face of the first fixture of the first handle arm in a direction substantially parallel to the central axis; and a second row of teeth, each tooth in said row extending outwardly and away from the crimp face of the second fixture of the second handle arm in a direction substantially parallel to the central axis.

2. The duct closure tool of claim 1, wherein the first row of teeth is spaced apart from the second row of teeth when the first handle arm and the second handle arm are in a closed position with their distal ends urged toward one another.

3. The duct closure tool of claim 2, wherein the first row of teeth is spaced apart from the second row of teeth when the first handle arm and the second handle arm are in an open position with their distal ends spaced apart from one another a distance greater than when the first handle arm and the second handle arm are in the closed position with their distal ends urged toward one another.

4. The duct closure tool of claim 1, wherein the first fixture has a substantially flat front face.

5. The duct closure tool of claim 1, wherein the second fixture has a substantially flat front face.

6. The duct closure tool of claim 1, wherein the teeth of the first row of teeth have pointed end(s) adapted for piercing insulation materials.

7. The duct closure tool of claim 1, wherein the teeth of the second row of teeth have pointed end(s) adapted for piercing insulation materials.

8. The duct closure tool of claim 1, wherein the spring is a helical torsion spring.

9. The duct closure tool of claim 1, wherein the first row of teeth extends in a direction substantially perpendicular to the central axis.

10. The duct closure tool of claim 1, wherein the second row of teeth extends in a direction substantially perpendicular to the central axis.

* * * * *